US009873582B2

(12) United States Patent
Stenavich

(10) Patent No.: US 9,873,582 B2
(45) Date of Patent: Jan. 23, 2018

(54) TAPE ROLL HOLDER

(71) Applicant: Robert W. Stenavich, San Diego, CA (US)

(72) Inventor: Robert W. Stenavich, San Diego, CA (US)

(73) Assignee: Robert W. Stenavich, San Diego, CA (US)

( * ) Notice: Subject to any disclaimer, the term of this patent is extended or adjusted under 35 U.S.C. 154(b) by 0 days.

(21) Appl. No.: 14/694,642

(22) Filed: Apr. 23, 2015

(65) Prior Publication Data

US 2016/0311637 A1 Oct. 27, 2016

(51) Int. Cl.

| | |
|---|---|
| ***B65H 16/00*** | (2006.01) |
| ***B65H 16/04*** | (2006.01) |
| ***B65H 75/24*** | (2006.01) |
| ***B65H 75/44*** | (2006.01) |

(52) U.S. Cl.

CPC ..... *B65H 16/005* (2013.01); *B65H 75/245* (2013.01); *B65H 75/446* (2013.01); *B65H 2402/411* (2013.01); *B65H 2402/413* (2013.01)

(58) Field of Classification Search

CPC ..... B65H 16/04; B65H 39/16; B65H 2707/11332; B65H 2402/411; B65H 35/0026; B65H 49/26; B65H 49/32

See application file for complete search history.

(56) References Cited

U.S. PATENT DOCUMENTS

| | | | | |
|---|---|---|---|---|
| 1,818,514 | A * | 8/1931 | Whitaker | B65H 75/22 224/162 |
| 2,470,250 | A | 5/1949 | Kienle | |
| 2,525,992 | A * | 10/1950 | Wynn | B65H 16/005 224/673 |
| 2,963,208 | A | 12/1960 | Yates et al. | |
| 3,217,955 | A | 11/1965 | Tinkey | |
| 3,260,431 | A | 7/1966 | Ference | |
| 3,589,634 | A * | 6/1971 | Mason | B65H 16/005 242/422.4 |
| 3,921,936 | A * | 11/1975 | Suter | B65H 35/0026 224/219 |
| 4,195,794 | A * | 4/1980 | Ricci | B65H 49/26 242/396.9 |
| 4,576,674 | A | 3/1986 | La Tarte | |
| 5,482,182 | A | 1/1996 | Thompson et al. | |
| 5,641,109 | A | 6/1997 | Willoughby | |
| 6,085,955 | A | 7/2000 | Hicks et al. | |
| 6,095,455 | A * | 8/2000 | Green | A45F 5/02 24/3.12 |
| 6,216,978 | B1 * | 4/2001 | Rodriguez | E04F 21/00 242/588.1 |
| 7,077,184 | B2 | 7/2006 | Merlins, Jr. et al. | |
| 7,201,201 | B2 | 4/2007 | Grenier | |
| 7,322,543 | B2 * | 1/2008 | Moores | B65H 16/04 242/588.6 |
| 9,033,197 | B2 * | 5/2015 | Bar | A45F 5/02 224/162 |

* cited by examiner

*Primary Examiner* — William A. Rivera

(74) *Attorney, Agent, or Firm* — Lanier Ford Shaver & Payne PC

(57) ABSTRACT

A tape roll holder includes a plate from which extends a cylindrical bearing formed from two or more arcuate prongs. A cylindrical spindle dimensioned to be snugly received within an axially defined hole in the roll of tape is mounted to the bearing such that it is allowed to rotate freely. A spring clip is included to allow the holder to be worn on a belt.

6 Claims, 3 Drawing Sheets

TAPE ROLL HOLDER

BACKGROUND

Field

The present disclosure relates to a holder for a roll of tape.

Description of the Problem/Related Art

Painting contractors often use masking tape to define boundaries of the area to be painted. A nagging problem for painters is the cumbersome use of the roll. The user holds the tape roll while pulling the desired length of tape, but must put it down when applying the tape, requiring the user to pick the roll up again to apply more tape. This results in extra movement for the painter in each tape application and can lead to misplacing the tape roll. A safety concern arises when the painter must use a ladder or must also hold multiple paintbrushes.

Heretofore, a painter would often insert his or her arm into the hole in a tape roll wearing it on the arm. For those whose hands are too big to fit through the hole, the roll would be held in a pants pocket, in a utility belt pouch, or on a utility belt hook. This still necessitates two hands to retrieve a length of tape.

SUMMARY

A tape roll holder includes a plate from which extends a cylindrical bearing formed from two or more arcuate prongs. A cylindrical spindle dimensioned to be snugly received within an axially defined hole in the roll of tape is mounted to the bearing such that it is allowed to rotate freely. A spring clip is included to allow the holder to be worn on a belt.

BRIEF DESCRIPTION OF THE DRAWINGS

The present invention is described with reference to the accompanying drawings. In the drawings, like reference numbers indicate identical or functionally similar elements.

DETAILED DESCRIPTION

Figure 1:
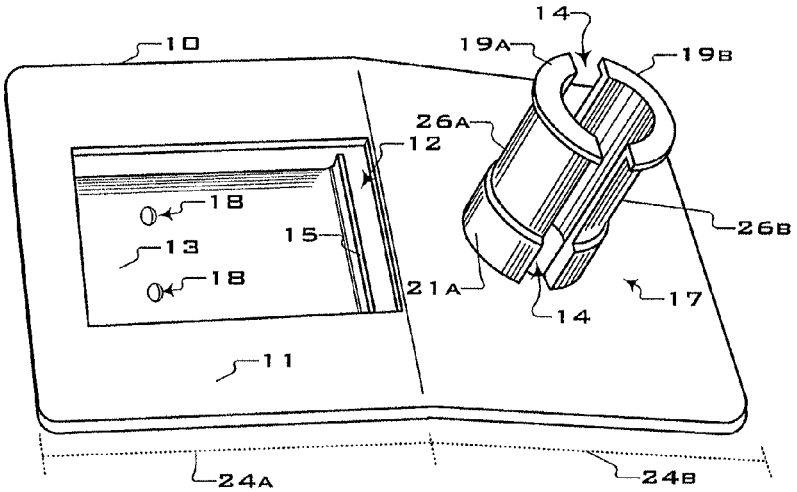
FIG. 1 illustrates and exemplary clip plate for a tape roll holder.
Figure 2:
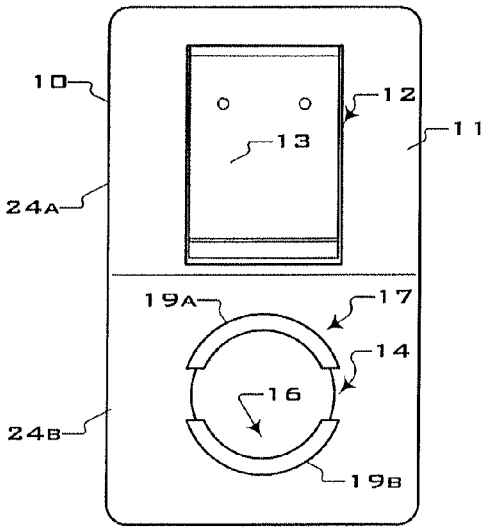
FIG. 2 is an elevation view of the outward side of the clip plate of FIG. 1.
Figure 3:
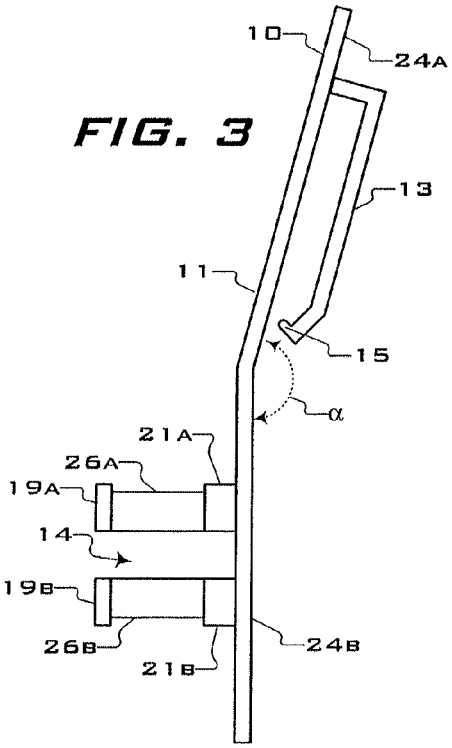
FIG. 3 is a side elevation view of the clip plate of FIG. 1.
Figure 4:
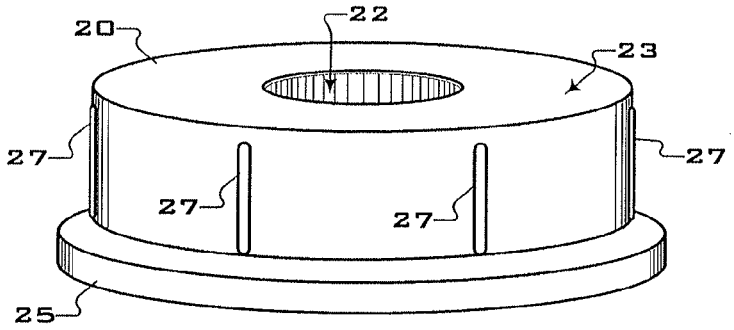
FIG. 4 is a perspective view of an exemplary spindle.
Figure 5:
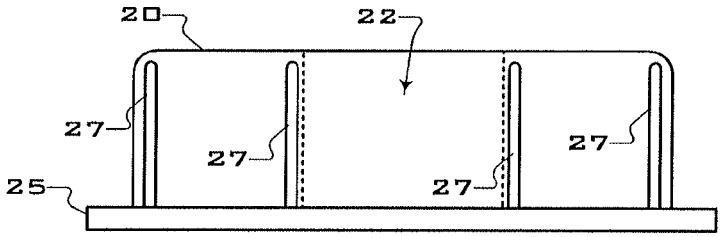
FIG. 5 is an elevation view of the spindle of FIG. 4.
Figure 6:
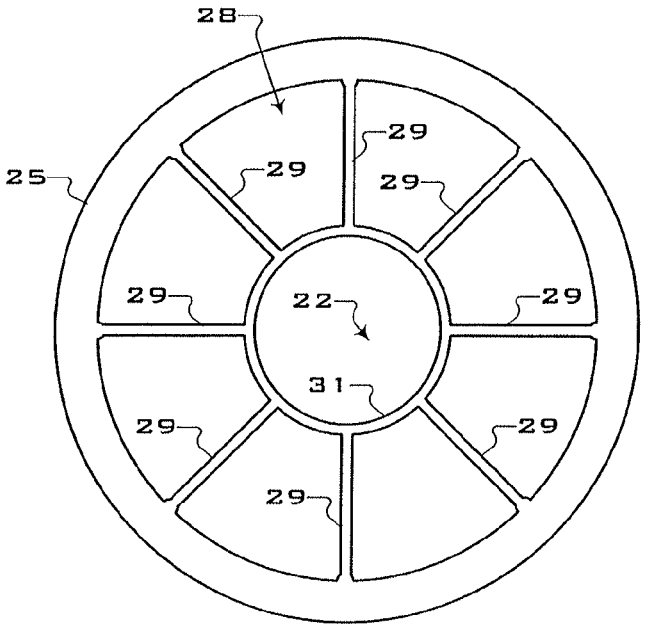
FIG. 6 is a bottom plan view of the spindle of FIG. 4.

The various embodiments of the present invention and their advantages are best understood by referring to FIGS. 1 through 8 of the drawings. The elements of the drawings are not necessarily to scale, emphasis instead being placed upon clearly illustrating the principles of the invention. Throughout the drawings, like numerals are used for like and corresponding parts of the various drawings.

This invention may be provided in other specific forms and embodiments without departing from the essential characteristics as described herein. The embodiments described above are to be considered in all aspects as illustrative only and not restrictive in any manner. The following claims rather than the foregoing description indicate the scope of the invention.

A clip plate 10 is configured with a plate 11 having first and second plate sections 24*a*, 24*b* disposed at an obtuse angle 20 with respect to each other. Both plate sections 24*a*, 24*b* comprise outward and inward planar surfaces. A spring clip 13 is disposed inward of the first plate section 24*a* extending roughly perpendicularly therefrom near one end of the plate 10, having a planar body disposed in parallel to the plate section 24*a* with a free end terminating in a flange 15. The spring clip 13 is configured to be relatively deformable but biased toward the plate 10 so that the clip 13 may be bent away from the plate 10 to be placed upon a user's belt and spring back toward the plate 10 when released. The spring clip 13 may also advantageously include one or more holes 18 defined therethrough.

A cylindrical bearing 17 extends perpendicularly away from the outward surface of the second plate section 24*b*. The bearing 17 is preferably bifurcated with a channel 14 bisecting the long axis thereof forming two arcuate prongs 26*a*, 26*b*. It will be appreciated that bearing may be comprised for more than two prongs 26*a*, 26*b*. The outward ends of the prongs 26*a*, 26*b* are terminated with arcuate retention flanges 19*a*, 19*b*, and each prong 26*a*, 26*b* may comprise an arcuate boss 21*a*, 21*b* surrounding their respective bases where they meet the front surface of the second plate section 24*b*.

The first section 24*a* may further comprise an opening 12 from one edge of which the spring clip 13 extends, while the second section 24*b* may comprise a circular opening 16 from the circumferential rim of which the prongs 26*a*, 26*b* extend.

A spindle 20 is also provided formed of a cylindrical hollow housing 23 having an open end and defining a cylindrical chamber 28 therein. The spindle 20 comprises a diameter to snugly be received within a spool of tape A. The interior of the chamber 28 may be formed with a hub 31 defining cylindrical hole 22 disposed coaxially with the housing 23 and dimensioned to receive bearing 17 such that the spindle 20 may rotate freely about the bearing 17. A plurality of support spokes 29 extend radially from the hub 31. The rim of the opening to the chamber is surrounded by a circumferential flange 25, and a plurality of raised ribs 27 extend radially along the exterior surface of the housing 23.

Figure 7:
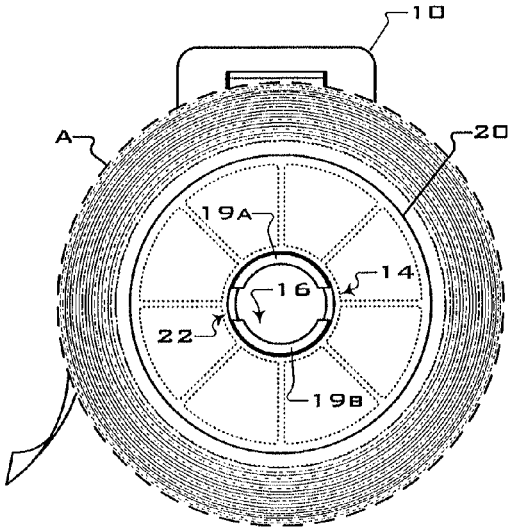
FIG. 7 is an elevation view of the outward side of the holder with a roll of tape mounted on the spindle which is mounted on the clip plate.
Figure 8:
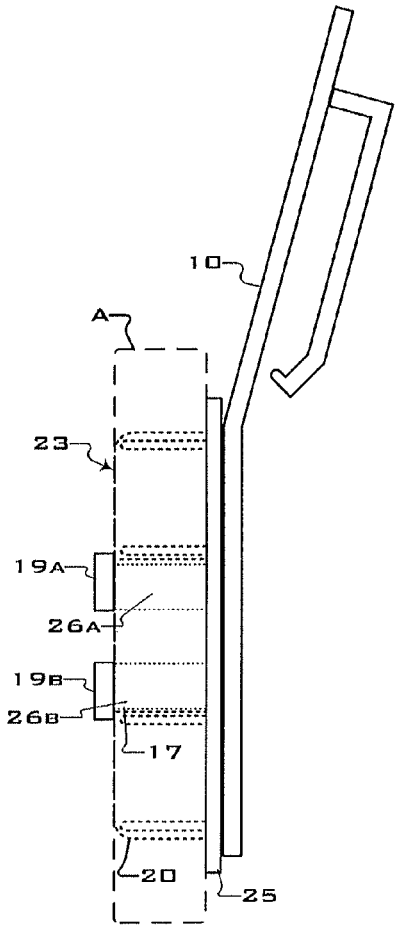
FIG. 8 is a side view of the tape roll holder shown in FIG. 7.

To use the apparatus, the spindle 20 is mounted to the bearing 17 on the clip 10 by pressing the prongs 26*a*, 26*b* toward each other and inserting both prongs 26*a*, 26*b* into the cylindrical hole 22 in the spindle 20 and pressing the spindle onto the clip 10 until the prongs 26*a*, 26*b* spring back into position. Retention flanges 19*a*, 19*b* engage the outward rim of hole 22 of the housing 23, as shown in FIGS. 7 & 8, and retain the spindle 20 on the clip 10 while allowing the spindle 20 to rotate freely around the bearing 17. Next, the spindle 20 is pressed into an axial hole in a roll of tape A such that the roll A fits snugly on the spindle 20. Ribs 27 provide friction to prevent the tape roll A from rotating about the spindle 20 when a length of tape is being drawn from the roll A.

As described above and shown in the associated drawings, the present invention comprises a tape roll holder. While particular embodiments have been described, it will be understood, however, that any invention appertaining to the method described is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention.

What is claimed is:

1. A holder for a roll of tape, said roll of tape having an axially defined hole, comprising:

a plate having an outward planar surface and an inward planar surface;

a cylindrical bearing extending from an opening in said outward surface, said bearing comprised of two separate arcuate prongs that are completely bifurcated with a partially circular channel defined by an arc-shape of each of the arcuate prongs bisecting an entire long axis of the cylindrical bearing, the channel extending longitudinally from outward ends of the prongs that are terminated with arcuate retention flanges to said outward planar surface of said plate and wherein said each arcuate prong of said cylindrical bearing comprises arcuate bosses surrounding their respective bases where each arcuate prong meets said outward planar surface;

a cylindrical spindle comprising a cylindrical hole dimensioned to receive said bearing and circumferential housing dimensioned to be snugly received within the axially defined hole in the roll of tape; and a spring clip extending from said inward planar surface and disposed roughly parallel thereto.

2. The holder for a roll of tape of claim 1, wherein said cylindrical spindle further comprises:

a hollow chamber defined within said housing;

a hub defining said cylindrical hole; and a plurality of spokes extending from said hub radially toward said housing.

3. The holder for a roll of tape of claim 2, wherein said housing further comprises a circumferential flange extending from said housing.

4. The holder for a roll of tape of claim 1, wherein said plate comprises first and second sections oriented at an obtuse angle to one another, and wherein said clip extends from the inward surface and parallel to said first section and said bearing extends from said outward surface of said second section.

5. . The holder for a roll of tape of claim 4, wherein said cylindrical spindle further comprises:

a hollow chamber defined within said housing;

a hub defining said cylindrical hole; and a plurality of spokes extending from said hub radially toward said housing.

6. The holder for a roll of tape of claim 5, wherein said housing further comprises a circumferential flange extending from said housing.

* * * * *